US005651597A

United States Patent [19]

Oslin

[11] Patent Number: 5,651,597

[45] Date of Patent: Jul. 29, 1997

[54] ADJUSTABLE TRAY/PAN SUPPORT RACK

[75] Inventor: G. Robert Oslin, Chicago, Ill.

[73] Assignee: Delaware Capital Formation, Inc., Wilmington, Del.

[21] Appl. No.: 739,499

[22] Filed: Oct. 28, 1996

Related U.S. Application Data

[63] Continuation of Ser. No. 300,627, Sep. 2, 1994, abandoned.

[51] Int. Cl.[6] ..... A47B 95/00

[52] U.S. Cl. ..... 312/350; 312/408; 312/410; 211/175; 108/102

[58] Field of Search ..... 312/350, 351, 312/126, 128, 132, 408, 410; 211/175, 990; 108/102, 137; 248/172

[56] References Cited

U.S. PATENT DOCUMENTS

| | | | |
|---|---|---|---|
| 1,370,717 | 3/1921 | Vacarezza | 312/410 X |
| 1,989,275 | 1/1935 | Hatch | 312/408 |
| 2,015,389 | 9/1935 | Whitted | 312/408 X |
| 2,671,004 | 3/1954 | Chadwick et al. | 312/350 |
| 2,742,559 | 4/1956 | Edelman | 312/350 X |
| 2,875,016 | 2/1959 | Fry | 312/351 |
| 3,332,558 | 7/1967 | Wilson | 211/175 |
| 4,533,056 | 8/1985 | Kirkorian . | |
| 4,553,523 | 11/1985 | Stohrer, Jr. . | |
| 4,575,164 | 3/1986 | Pinnow et al. . | |
| 4,669,692 | 6/1987 | Mastrodicasa . | |
| 4,848,608 | 7/1989 | Anderson . | |

FOREIGN PATENT DOCUMENTS

| | | | |
|---|---|---|---|
| 447235 | 5/1936 | United Kingdom | 108/137 |

*Primary Examiner*—Peter M. Cuomo
*Assistant Examiner*—Janet M. Wilkens
*Attorney, Agent, or Firm*—Welsh & Katz, Ltd.

[57] ABSTRACT

An adjustable support rack for releasable mounting within an oven chamber or the like includes a plurality of rack members secured in parallel spaced relation to transverse support rods which facilitate releasable mounting on an upstanding sidewall of the oven chamber with the rack members closely adjacent the sidewall to support trays or pans of maximum lateral width. A second pair of support rods are cooperative with the rack members to enable mounting on the sidewall with the rack members spaced from the sidewall so as to cooperate with fixed rack members on a laterally opposite upstanding sidewall of the oven chamber to support trays and pans of shorter lateral width.

16 Claims, 1 Drawing Sheet

ADJUSTABLE TRAY/PAN SUPPORT RACK

This application is a continuation of application Ser. No. 08/300,627 filed on Sep. 2, 1994, now abandoned.

BACKGROUND OF THE INVENTION

The present invention relates generally to support racks for supporting trays and pans in oven chambers and the like, and more particularly to a novel adjustable support rack for mounting on an upstanding sidewall of an oven chamber to facilitate support of trays and pans of different lateral widths.

It is a common practice in the food industry to prepare food products for baking or cooking in an oven by placing one or more of the food products in a pan or on a tray which is then inserted into an oven chamber or compartment so that laterally opposite marginal edges of the pan or tray are supported on horizontal support racks secured to or formed integral with laterally opposed upstanding sidewalls of the oven chamber. Because the oven chamber has a fixed lateral width, and since the support racks are conventionally formed integral with or secured in relatively fixed relation to the laterally opposed sidewalls, the pans and trays must be made to the same lateral width to enable edge support within the same oven chamber. Pans and trays having different lateral widths cannot be supported in a normal manner in the same oven chamber. For example, commercial steamer pans generally have a lateral width of approximately 20 inches, a front-to-back or transverse width of approximately 12 inches, and a vertical depth of approximately 2.5 inches. Steam chambers in many commercial steamers generally have a lateral width of approximately 20 inches and a front-to-back depth of approximately 26–30 inches, thereby enabling two steamer pans to be supported by their lateral marginal edges on each pair of laterally opposed support rack members.

Commercial baking trays, on the other hand, generally have a lateral width of approximately 18 inches, a front-to-back width of approximately 26 inches, and a vertical depth of approximately 1 inch. Thus, ovens having support racks secured to laterally opposite upstanding sidewalls of their oven chambers for supporting the lateral marginal edges of conventional 20 inch wide steamer pans cannot also support cooking trays having 18 inch lateral widths by their lateral marginal edges, and vice versa.

Prior attempts to support steamer pans and baking trays of different lateral widths within the same oven or steamer chamber have included the use of bridging members which are supported on and extend between laterally opposed pairs of support rack members on the oven chamber sidewalls so that shorter width trays or pans are supported on the bridging members.

It has also been proposed to support different width trays within a food service cart by providing slider members which are secured to slotted uprights within the service cart and formed to establish two horizontal shelf levels, an upper shelf level for wide trays and a lower shelf level for narrower width trays or pans. See, for example, U.S. Pat. No. 4,574,164.

A significant drawback in prior techniques for supporting different width trays or pans within the same oven chamber or compartment, such as by bridging members, is that they entail separate components which may be misplaced and lead to lost operating time in preparing the chamber for supporting narrow or shorter width trays or pans. The prior techniques also frequently require a relatively complex mounting arrangement which does not lend itself to use in food preparation ovens and steamer chambers, such as the aforedescribed double level tray support sliders.

SUMMARY OF THE INVENTION

One of the primary objects of the present invention is to provide a novel adjustable support rack for use in an oven chamber or the like to facilitate edge support of different width trays and pans.

A more particular object of the present invention is to provide a novel adjustable support rack for releasable mounting on an upstanding sidewall of an oven chamber or the like, the support rack having a plurality of horizontal rack members cooperable with similar rack members supported in relatively fixed relation on an opposite sidewall of the oven chamber to enable edge support of a plurality of trays across the full lateral width of the oven chamber, and being easily adjustable to enable edge support of shorter width trays or pans.

In carrying out the present invention, an adjustable support rack for use in an oven chamber or the like is provided having a plurality of rack members secured in parallel spaced relation to a pair of support rods disposed transverse to the rack members. The support rods have upper and lower ends which are cooperable with brackets formed on an upstanding lateral sidewall of the oven chamber to support the rack members in close proximity to the sidewall. In this position, the support rack members are disposed opposite similar support rack members secured to the laterally opposite upstanding sidewall of the oven chamber and cooperate therewith to provide edge support for trays or pans having lateral widths substantially equal to the lateral width of the oven chamber, such as approximately 20 inches. The adjustable support rack has a second pair of support rods, at least one of which is pivotally adjustable, which enable the support rack to be releasably mounted on the upstanding oven sidewall so that the rack members are spaced from the sidewall and cooperate with the laterally opposite support rack members to provide edge support for trays and pans having shorter lateral width, such as 18 inches.

A feature of the adjustable tray and pan support rack in accordance with the invention is the ability to readily remove the support rack from the oven chamber sidewall for adjustment to accommodate longer or shorter width trays without having to remove the support rack from the oven chamber.

Another feature of the adjustable support rack in accordance with the present invention is its relatively economical construction and the ability to readily remove the support rack from the oven chamber for cleaning.

Further objects, features and advantages of the adjustable support rack in accordance with the present invention will become apparent from the following detailed description taken with the accompanying drawing wherein like reference numerals designate like elements throughout the several views.

DETAILED DESCRIPTION

Figure 1:
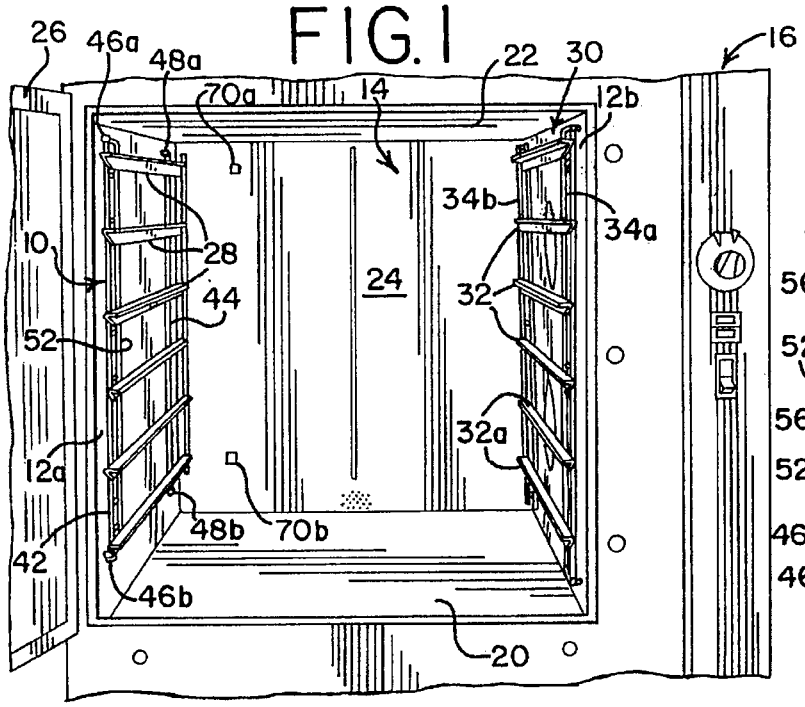
FIG. 1 is a fragmentary front elevational view of an oven having an adjustable tray and pan support rack in accordance with the present invention supported in the oven chamber in position to support maximum width trays or pans.

Referring now to the drawing, an adjustable tray and pan support rack constructed in accordance with the present invention is indicated generally at 10. For purposes of illustration, the adjustable support rack 10 is shown releasably mounted on an upstanding sidewall 12*a* of a rectangular oven chamber 14 formed within an oven, a fragmentary portion of which is indicated generally at 16. The oven 16 may comprise a gas-fired or electric-powered cooking oven such as commercially available from Groen/A Dover Industries Company, Elk Grove Village, Ill. The oven chamber 14 is bounded on its right-hand side by an upstanding sidewall 12*b* which is laterally spaced from the sidewall 12*a*. The oven chamber is further bounded by a lower horizontal surface 20, an upper horizontal surface 22 and an upstanding rear wall 24 which intersects the upstanding sidewalls and lower and upper surfaces 20 and 22 at right angles. A door, a fragmentary portion of which is indicated at 26, is adapted to seal about the periphery of the oven chamber opening when in a closed position.

The support rack 10 includes a plurality of rack members 28 which may be angle-shaped in transverse cross section as illustrated or comprise generally C-shaped channels. When mounted on the sidewall 12*a* of the oven chamber, the tray and pan support rack 10 is adjustable to a first position wherein the rack members 28 are disposed closely adjacent the wall 12*a* to enable cooperation with a support rack 30 mounted on the laterally opposite sidewall 12*b* to support trays or pans having lateral widths slightly less than the lateral width of the oven chamber, as considered between the upstanding sidewalls 12*a* and 12*b*. The support rack 30 is of conventional design and includes a plurality of rack members 32 which are similar to the rack members 28 and are fixed in transverse relation to a pair of support rods 34*a* and 34*b* adapted to be releasably mounted on sidewall 12*b* so that the rack members 32 are disposed in horizontal vertically spaced relation adjacent the sidewall 12*b*. The rack members 32 have substantially horizontal flanges 32*a* which are adapted for cooperation with horizontal flanges 28*a* on the corresponding laterally opposed rack members 28 on the adjustable support rack 10 to support lateral edges of trays and pans as will be more fully described.

Figure 4:
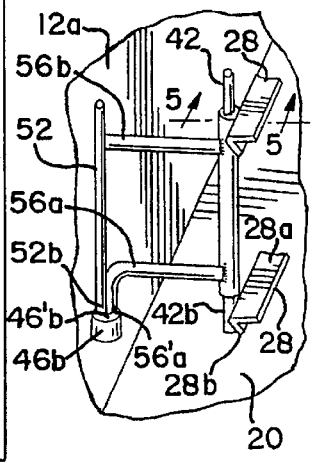
FIG. 4 is a fragmentary perspective view, on an enlarged scale, illustrating the manner of supporting the lower end of the adjustable support rack on the oven sidewall.
Figure 3:
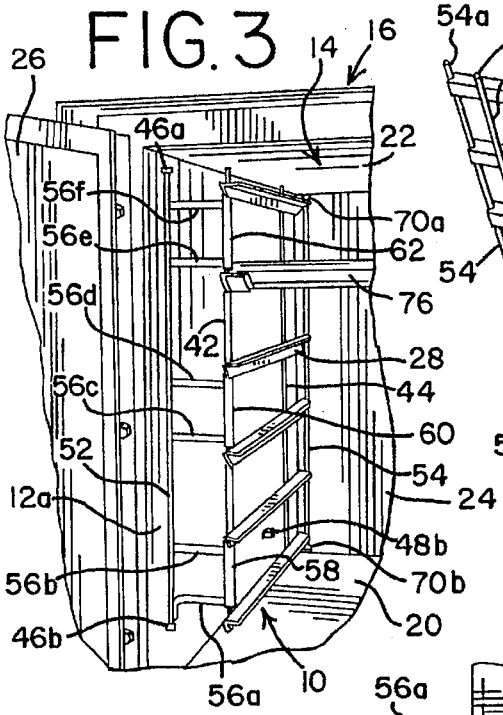
FIG. 3 is a fragmentary perspective view of the oven of FIG. 1 with the adjustable support rack positioned to support shorter lateral width trays or pans within the oven chamber.
Figure 2:
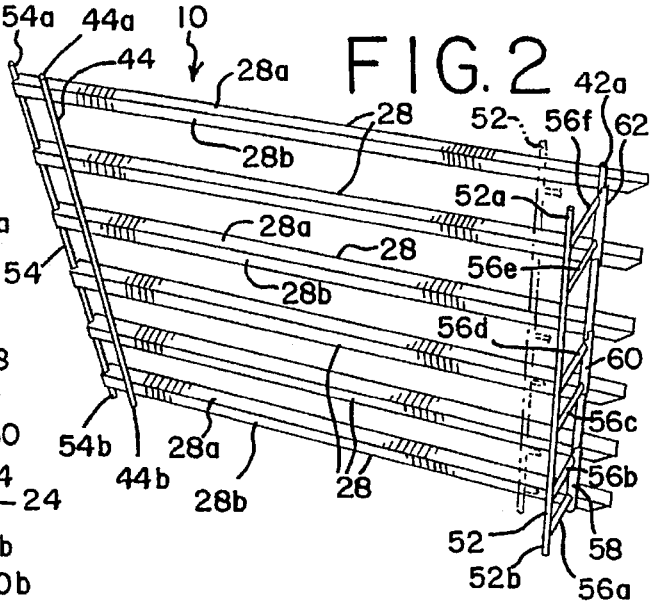
FIG. 2 is a perspective view of the adjustable support rack in accordance with the present invention removed from the oven chamber.

As illustrated in FIG. 2, the rack members 28 on the adjustable support rack 10 have depending flanges 28*b* fixed to first support means in the form of a first pair of support rods 42 and 44 so that the rack members 28 are supported in vertically spaced parallel relation transverse to the support rods 42 and 44. The support rods 42 and 44 are adapted to be releasably mounted on the sidewall 12*a* of the oven chamber 14 so that the rack members 28 are disposed relatively close to the sidewall and each is laterally opposite a corresponding rack member 32 on the support rack 30. To this end, each of the support rods 42 and 44 has upper and lower ends, indicated at 42*a*, 42*b* and 44*a*, 44*b*, respectively, which are adapted to be releasably inserted within vertically spaced generally U-shaped pairs of support brackets, indicated at 46*a*, 46*b* and 48*a*, 48*b*, formed integral with or secured to the sidewall 12*a*, as illustrated in FIGS. 1, 3 and 4. The upper and lower rack members 28 on the adjustable support rack 10, respectively, are spaced downwardly from the upper ends 42*a* and 44*a* of the support rods 42 and 44 and upwardly from the lower ends 42*b* and 44*b* thereof to allow the upper ends of the support rods to first be inserted upwardly through the upper support brackets 46*a* and 48*a* whereafter the lower ends of the support rods may be inserted downwardly within the support brackets 46*b* and 48*b* while the upper ends of the rods are retained within the upper brackets, thus enabling releasable mounting of the adjustable support rack on the upstanding sidewall 12*a* with the rack members 28 in close proximity to the sidewall.

The adjustable tray and pan support rack 10 includes second support means in the form of a second pair of support rods 52 and 54 which enable releasable mounting of support rack 10 on the sidewall 12*a* with the rack members 28 spaced laterally outwardly from and parallel to the sidewall 12*a*, as illustrated in FIG. 3. The support rod 52 is pivotally hinged to the support rod 42 to enable movement between a position disposed adjacent the rack members 28, as shown in phantom in FIG. 2, to enable mounting of the support rack 10 on the sidewall 12*a* with the rack members 28 proximate the sidewall, and a position spaced from the rack members 28 a distance sufficient to position the rack members a predetermined distance from the sidewall 12*a* when mounted thereon. In the latter position, the rack members 28 are spaced from their corresponding rack members 32 on the opposing sidewall 12*b* to support trays and/or pans of narrower lateral width then can be supported with the rack members 28 adjacent sidewall 12*a*.

The support rod 52 has a plurality of transverse connector members 56*a–f* of substantially equal length fixed in normal relation to the support rod 52, as by welding, and spaced along its length as illustrated in FIGS. 2 and 3. In the illustrated embodiment, the lower pair of connector members 56*a* and 56*b* have their ends opposite the support rod 52 connected to a hinge sleeve 58 coaxial on the support rod 42 between the lowermost pair of rack members 28. The connector members 56*c* and 56*d* have their ends opposite the support rod 52 fixed to a hinge sleeve 60 which is coaxial on support rod 42 between the intermediate pair of rack members 28. The uppermost pair of connector members 56*e* and 56*f* have their ends opposite the support rod 52 fixed to a hinge sleeve 62 which is coaxial on the support rod 42 between the uppermost pair of rack members 28. The hinge sleeves 58, 60 and 62 enable the support rod 52 to be pivoted about the axis of the support rod 42 between a position lying against the vertical flanges 28*b* of the rack members 28, as shown in phantom in FIG. 2, and a position wherein the connector members 56*a–f* are at 90° angles or normal to the rack members, as shown in solid lines.

Figure 5:
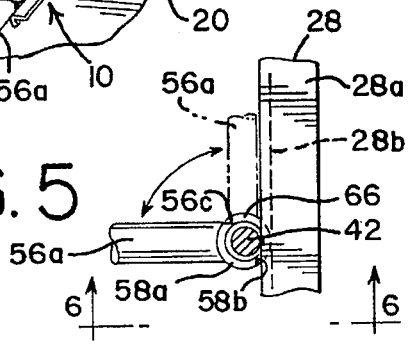
FIG. 5 is a fragmentary horizontal sectional view taken substantially along line 5—5 of FIG. 4 but on an enlarged scale.
Figure 6:
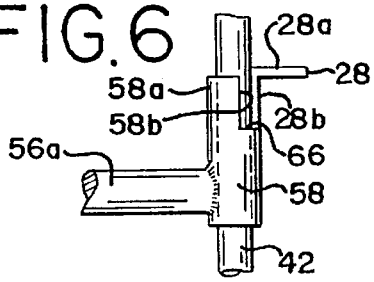
FIG. 6 is a fragmentary elevational view taken substantially along line 6—6 of FIG. 5.

In the embodiment illustrated in FIGS. 5 and 6, the upper end of each of the hinge sleeves 58, 60 and 62 is cut away or recessed so as to form an upwardly extending arcuate segment of the sleeve, such as indicated at 58*a* in FIG. 6. Each sleeve segment, such as 58*a*, defines a pair of vertical stop surfaces 58*b* and 58*c* which are arcuately spaced from each other and positioned to cooperate with the vertical flange portion 28*b* of the corresponding rack member 28 to limit rotational movement of the support rod 52 about the support rod 42 between its non-operating position lying substantially against the rack members 28 and its operating position wherein the connector members 56*a–f* are substantially transverse to the rack members. Each hinge sleeve 58, 60 and 62 also as an arcuate planar transverse surface formed at the base of its upwardly extending arcuate segment portion 58*a*, 60*a* and 62*a*, such as indicated at 66 in FIGS. 5 and 6. These arcuate surfaces serve to receive the lower edges of the depending vertical flanges 28*b* on the adjacent rack members 28 and thereby support the rack members on the hinge sleeves when the support rod 52 is mounted on the upstanding sidewall 12*a* so as to space the rack members outwardly from the sidewall. Alternatively, the upward extensions 58*a*, 60*a* and 62*a* on the hinge sleeves 58, 60, and 62, respectively, can be eliminated so that the lower edges of the rack members 28 rest on planar upper end surfaces on the hinge sleeves.

To facilitate releasable mounting of the support rod 52 on the sidewall 12*a*, support rod 52 has upper and lower ends 52*a* and 52*b*, respectively, which are adapted to be releasably inserted within the upper and lower support brackets 46*a* and 46*b* on sidewall 12*a*. This is accomplished by first inserting the upper end 52*a* upwardly through the upper mounting bracket 46*a* sufficiently to allow the lower end 52*b* to then be inserted downwardly through the lower mounting bracket 46*b*. As shown in FIG. 4, the lowermost connector rod 56*a* has an L-shape so that a lower end 56'*a* engages an upper edge surface 46'*b* on bracket 46*b* to thereby limit downward movement of support rod 52 within bracket 46*b*.

In similar fashion, the support rod 54, which is fixed in transverse relation to the rearward ends of the rack members 28, has upper and lower ends 54*a* and 54*b*, respectively, which are adapted to be releasably retained within generally U-shaped upper and lower support brackets 70*a* and 70*b*, respectively, formed on or fixed to the back wall 24 of the oven chamber similar to the support brackets 46*a,b* and 48*a,b*. The support brackets 70*a* and 70*b* are spaced laterally from the sidewall 12*a* a distance substantially equal to the lateral distance between the support rods 42 and 52 so that with the upper and lower ends of the support rod 54 mounted within the brackets 70*a* and 70*b*, the rack members 28 lie parallel to the sidewall 12*a*.

Summarizing the operation of the adjustable tray and pan support rack 10, if it is desired to support trays or pans of maximum lateral width within the oven chamber 14, the support rack 10 is mounted on the sidewall 12*a* with the adjustable support rod 52 rotated against the rear surfaces of the rack members 28 and with the upper and lower ends of the support rods 42 and 44 mounted within the support brackets 46*a,b* and 48*a,b*. In this manner, the rack members 28 are substantially parallel to and laterally opposite corresponding rack members 32 on the opposite sidewall 12*b* of the oven chamber to support lateral marginal edges of trays or pans of maximum lateral width such as indicated at 76 in FIG. 3.

When it is desired to support pans or trays of shorter lateral width, such as baking trays having generally 18 inch lateral width, as opposed to 20 inch wide steamer pans, the support rack 10 is released from the support brackets 46*a,b* and 48*a,b* and the support rod 52 is rotated or pivoted to a position disposed substantially 90° relative to the rack members 28, as shown in FIG. 2. The rack 10 is then remounted on sidewall 12*a* with the upper and lower ends of support rod 52 mounted within the brackets 46*a,b*, and the upper and lower ends of support rod 54 mounted within the support brackets 70*a* and 70*b*. In this position, the rack members 28 are spaced outwardly from the sidewall 12*a* and cooperate with the corresponding opposite rack members 32 to support trays or pans of shorter lateral width.

The adjustable support rack 10 is preferably made from a suitable strength non-corrosive metallic material, such as stainless steel, to withstand various environmental conditions and lend itself to sanitized cleaning.

It will be appreciated that while the adjustable support rack 10 has been described for mounting on the left-hand sidewall 12*a* of the oven chamber, it could be readily made to releasably mount on the right-hand sidewall 12*b* for cooperation with a fixed position rack on the opposed sidewall similar to rack 30.

While a preferred embodiment of the present invention has been illustrated and described, it will be understood to those skilled in the art that changes and modifications may be made therein without departing from the invention in its broader aspects. Various features of the invention are defined in the following claims.

What is claimed is:

1. A support rack for supporting the lateral edge of at least one tray or pan within a chamber bounded by an upstanding boundary wall having rack support brackets thereon, said support rack including at least one elongated rack member, a first pair of elongated support rods secured to said rack member in generally transverse relation thereto, said first pair of support rods having free opposite ends adapted for cooperation with support brackets on the boundary wall so as to enable releasable support of said rack member in a generally horizontal orientation relatively close to the boundary wall, and a second pair of support rods operatively connected to said rack member and disposed generally parallel to said first support rods, said second pair of support rods including a first elongated support rod having free opposite ends and being hingedly connected to a support rod of said first pair of support rods and movable between a first position disposed adjacent said rack member to enable mounting of the support rack on the boundary wall through the first pair of support rods with the rack member in said relatively close proximity to the wall, and a second position spaced from said rack member and adapted for cooperation with support brackets on the boundary wall so as to releasably support said support rack in outwardly spaced generally parallel relation from the boundary wall.

2. A support rack as defined in claim 1 wherein said support rack includes a plurality of said elongated rack members secured to said first pair of support rods so as to lie in parallel spaced relation generally transverse to said support rods.

3. A support rack as defined in claim 1 wherein said second pair of support rods includes a second support rod fixed to said rack member and adapted to cooperate with support brackets on a rear wall of the boundary wall to support said rack member in spaced relation to a sidewall of the boundary wall.

4. A support rack as defined in claim 3 wherein said first and second pairs of support rods each have upper and lower ends enabling releasable mounting of said support rods on pairs of support brackets.

5. A support rack as defined in claim 1 wherein said first elongated support rod of said second pair of support rods has at least one hinge sleeve secured thereto in parallel spaced relation, said hinge sleeve being coaxial on a selected one of said first pair of support rods to enable hinged movement of said first elongated support rod of said second pair of support rods between its said first and second positions relative to said rack member.

6. A support rack as defined in claim 5 wherein said hinge sleeve includes means limiting rotation thereof about said selected one of said first pair of support rods.

7. In a chamber having at least one upstanding sidewall, and tray support means for supporting at least one tray or pan of a first lateral width in a substantially horizontal position, said tray support means including a support rack cooperative with said upstanding sidewall and having at least one rack member for supporting a lateral marginal edge of the tray, the improvement wherein said support rack includes means enabling adjustment relative to said upstanding sidewall between a first position wherein said rack member is proximate said sidewall for supporting said lateral edge of the tray, and a second position wherein said rack member is spaced from said sidewall in substantially parallel relation thereto for supporting a lateral edge of a tray or pan having a lateral width less than said first lateral width.

8. Tray support means as defined in claim 7 wherein said support rack includes a plurality of elongated vertically spaced rack members movable between said first and second positions, each of said rack members being adapted to support a lateral edge of a tray or pan.

9. Tray support means as defined in claim 8 wherein said support rack includes a first pair of parallel spaced support rods having said rack members fixed in transverse relation thereto, said upstanding sidewall having first and second pairs of vertically aligned support brackets, each pair of said support brackets being cooperative with a selected one of said support rods to releasably support said support rack with said rack members in said first position proximate said sidewall, said support rack including a second pair of support rods at least one of which is cooperable with selected ones of said support brackets to support said support rack in a second position wherein said rack members are spaced from said sidewall.

10. Tray support means as defined in claim 9 wherein said second pair of support rods includes a support rod hinged to one of said first pair of support rods for movement between a position adjacent said rack members and a position spaced therefrom, said hinged support rod being cooperable with one pair of said vertically spaced support brackets on said sidewall to support said rack members in spaced relation to said sidewall, said second pair of support rods including a support rod fixed to said rack members and cooperative with a second wall of the chamber to assist in supporting said rack members in said spaced relation to said sidewall.

11. In a food processing chamber having generally upstanding laterally opposite sidewalls, and tray support means associated with each of said sidewalls for supporting at least one tray or pan adjacent its lateral edges in a generally horizontal position between said sidewalls, the improvement wherein the tray support means associated with at least one of the sidewalls comprises a support rack having a plurality of rack members, and means enabling adjustment of said support rack between a first position wherein said rack members are proximate said one of said sidewalls for supporting the lateral edge of a tray having a lateral width approximately equal to the lateral distance between the sidewalls, and a second position wherein said rack members are spaced outwardly from and parallel to said one of said sidewalls for supporting the lateral edges of one or more trays or pans of shorter lateral width.

12. Tray support means as defined in claim 11 wherein the food processing chamber has a generally transverse rear end wall intersecting said one of said sidewalls to form a corner of the chamber, said transverse end wall and said one of said sidewalls having support bracket means thereon, said support rack associated with said one of said sidewalls including first support means adapted for supporting cooperation with said support bracket means on said one of said sidewalls to support said support rack in said first position, said support rack including second support means adapted for supporting cooperation with bracket means on said one of said sidewalls and bracket means on said transverse end wall so as to support said rack members in spaced relation to said one of said sidewalls to facilitate support of trays and pans of shorter lateral width.

13. Tray support means as defined in claim 12 wherein said tray support means associated with each of said sidewalls comprises a support rack having a plurality of vertically spaced substantially horizontal rack members cooperative to support laterally opposite edges of a plurality of trays or pans in vertically spaced relation, said tray support means associated with said one of said sidewalls having a first pair of support rods secured to and supporting its rack members in transverse relation to said support rods and being releasably cooperative with said one of said sidewalls to support its said rack members in close proximity to said one of said sidewalls, said tray support means associated with said one of said sidewalls including a second pair of support rods secured to said rack members in a manner to enable support of said tray support means with its rack members in parallel spaced relation from said one of said sidewalls to enable support of the lateral edges of trays and pans of shorter lateral width.

14. A support rack for supporting the lateral edge of a tray or pan comprising, in combination, a first pair of coplanar substantially parallel laterally spaced elongated support rods having exposed free opposite ends, at least one elongated rack member secured directly to said first pair of support rods in generally transverse relation thereto so that supporting said support rods in generally upstanding relation disposes the rack member in a horizontal orientation, and a second pair of elongated support rods interconnected to said rack member generally adjacent opposite ends thereof and in generally parallel relation to said first pair of support rods, said second pair of support rods including an elongated support rod having exposed free opposite ends and hinged to a support rod of said first pair of support rods and movable between a first position disposed adjacent said rack member and a second position spaced from said rack member so as to enable support of said rack member in close proximity to an upstanding wall through mounting of the first support rods on the wall, and support of said rack member in spaced relation from the upstanding wall when said hinged support rod is in its said second position and is mounted on the wall.

15. A support rack as defined in claim 14 wherein said support rack includes a plurality of said elongated rack members secured to said first pair of support rods so as to lie in parallel spaced relation generally transverse to said support rods.

16. A support rack as defined in claim 15 wherein said hinged support rod of said second pair of support rods has at least one hinge sleeve secured thereto in parallel spaced relation, said hinge sleeve being coaxial on a selected one of said first pair of support rods to enable hinged movement of said hinged support rod between its said first and second positions relative to said rack members.

* * * * *